US011999582B2

(12) United States Patent
Yamaguchi et al.

(10) Patent No.: US 11,999,582 B2
(45) Date of Patent: Jun. 4, 2024

(54) SHEET FEEDING DEVICE, SHEET READING APPARATUS INCLUDING THE SHEET FEEDING DEVICE, AND IMAGE FORMING APPARATUS INCLUDING THE SHEET READING APPARATUS

(71) Applicant: CANON KABUSHIKI KAISHA, Tokyo (JP)

(72) Inventors: Takuya Yamaguchi, Chiba (JP); Takeshi Hino, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 198 days.

(21) Appl. No.: 17/165,646

(22) Filed: Feb. 2, 2021

(65) Prior Publication Data

US 2021/0237992 A1 Aug. 5, 2021

(30) Foreign Application Priority Data

Feb. 5, 2020 (JP) ..... 2020-018273

(51) Int. Cl.

| | |
|---|---|
| ***B65H 7/02*** | (2006.01) |
| ***B65H 1/04*** | (2006.01) |
| ***B65H 3/06*** | (2006.01) |
| ***B65H 3/56*** | (2006.01) |

(52) U.S. Cl.

CPC ..... *B65H 3/0684* (2013.01); *B65H 1/04* (2013.01); *B65H 3/56* (2013.01); *B65H 7/02* (2013.01); *B65H 2801/06* (2013.01)

(58) Field of Classification Search

CPC ..... B65H 7/04; B65H 7/14; B65H 3/0684

See application file for complete search history.

(56) References Cited

U.S. PATENT DOCUMENTS

| | | | | |
|---|---|---|---|---|
| 7,063,315 | B2 * | 6/2006 | Lyu | B65H 3/0607 271/38 |
| 9,602,689 | B2 * | 3/2017 | Lee | H04N 1/00588 |
| 2009/0140490 | A1 * | 6/2009 | Kozaki | B65H 3/06 271/109 |
| 2018/0099825 | A1 * | 4/2018 | Sata | G03G 15/602 |

FOREIGN PATENT DOCUMENTS

| | | | |
|---|---|---|---|
| JP | 2009132521 | A | 6/2009 |
| JP | 2015196545 | A | 11/2015 |
| JP | 2016210544 | A | 12/2016 |

* cited by examiner

*Primary Examiner* — Howard J Sanders

(74) *Attorney, Agent, or Firm* — Canon U.S.A., Inc. I.P. Division

(57) ABSTRACT

A sheet feeding device includes a stacking portion, a sheet detecting portion including a movable member, a first sheet feeding roller, a second sheet feeding roller, and a sheet separating member. When the first feeding roller is in a sheet feeding position, with respect to a widthwise direction of the sheet perpendicular to a sheet feeding direction, a contact position where the movable member contacts the sheet is in a region in which the first sheet feeding roller contacts the sheet, as viewed in the sheet feeding direction.

8 Claims, 11 Drawing Sheets

(a)

(b)

(a)

(b)

(a)

(b)

(a)

(b)

(c)

SHEET FEEDING DEVICE, SHEET READING APPARATUS INCLUDING THE SHEET FEEDING DEVICE, AND IMAGE FORMING APPARATUS INCLUDING THE SHEET READING APPARATUS

BACKGROUND

Field of the Invention

The present invention relates to a sheet feeding device for separating and feeding sheets of a sheet bundle, stacked on a sheet tray, one by one, and relates to a sheet reading apparatus including the sheet feeding device and an image forming apparatus including the sheet feeding device and the sheet reading apparatus.

Related Art

Conventionally, at an upper portion of an image forming apparatus, a sheet feeding device including a feeding portion for feeding stacked sheets of a sheet bundle one by one and including a reading portion for reading an image of a fed sheet is provided. In the sheet feeding device, a sheet detecting portion is provided for detecting presence or absence of the sheet(s) stacked on a sheet tray.

The sheet detecting portion is constituted by a flag and a (light) transmission-type sensor, and a constitution in which the flag is operated by a self-weight of the sheets when the sheet bundle is set on the sheet tray and then in interrelation with an operation of the flag, light is transmitted through the transmission type sensor or is blocked by the flag is employed. Then, the sheet is detected, and thereafter, the stacked sheet is fed to the reading portion by rotation of the feeding roller in contact with the sheet.

In Japanese Laid-Open Patent Application 2015-196545, as regards the flag, with respect to a widthwise direction of the sheet perpendicular to a feeding direction of the sheet, a position where the flag contacts the sheet is on a side closer to a side end of the sheet than a position where a pick-up roller contacts the sheet is. However, in recent years, with expansion of product specification of the sheet feeding device, it is required that various kinds of paper from thin paper to thick paper are fed by the sheet feeding device. In the conventional constitution, an end portion of the sheet with respect to a widthwise direction receives an upward force from the flag, and therefore, in the case where a sheet of the thin paper is fed, the end portion of the sheet was raised in some instances. In this state, when the sheet was fed, there was a liability that the sheet caused oblique movement, paper (sheet) jam, or the like.

SUMMARY OF THE INVENTION

A principal object of the present invention is to provide a sheet feeding device, in which presence or absence of a sheet is detected by operating a flag, capable of reducing a degree of improper feeding, such as a jam of the sheet, a corner fold of the sheet or oblique movement of the sheet when the sheet is fed.

According to an aspect of the present invention, there is provided a sheet feeding device comprising: a stacking portion including a stacking surface on which a sheet is stacked; a sheet detecting portion provided in the stacking portion and configured to detect presence or absence of the sheet stacked on the stacking surface, wherein the sheet detecting portion includes a movable member which is provided so as to project from the stacking surface upward in a vertical direction and which is movable in contact with the sheet when the sheet is stacked on the stacking surface, and includes a detecting portion configured to detect an end of the movable member; a first feeding roller movable between a separated position where the first feeding roller is separated upward with respect to the vertical direction from the sheet staked on the stacking surface and a feeding position where the first feeding roller moves from the separated position downward in the vertical direction and contacts and feeds the sheet stacked on the stacking portion; a second feeding roller provided on a side downstream of the first feeding roller with respect to a sheet feeding direction and configured to feed the sheet; and a separating member press-contacting a surface of the second feeding roller and configured to separate sheets, fed by the first feeding roller, one by one, wherein when the first feeding roller is in the feeding position, with respect to a widthwise direction of the sheet perpendicular to the sheet feeding direction, a contact position where the movable member contacts the sheet is in a region in which the first feeding roller contacts the sheet, as viewed in the sheet feeding direction.

Further features of the present invention will become apparent from the following description of exemplary embodiments with reference to the attached drawings.

Figure 6:
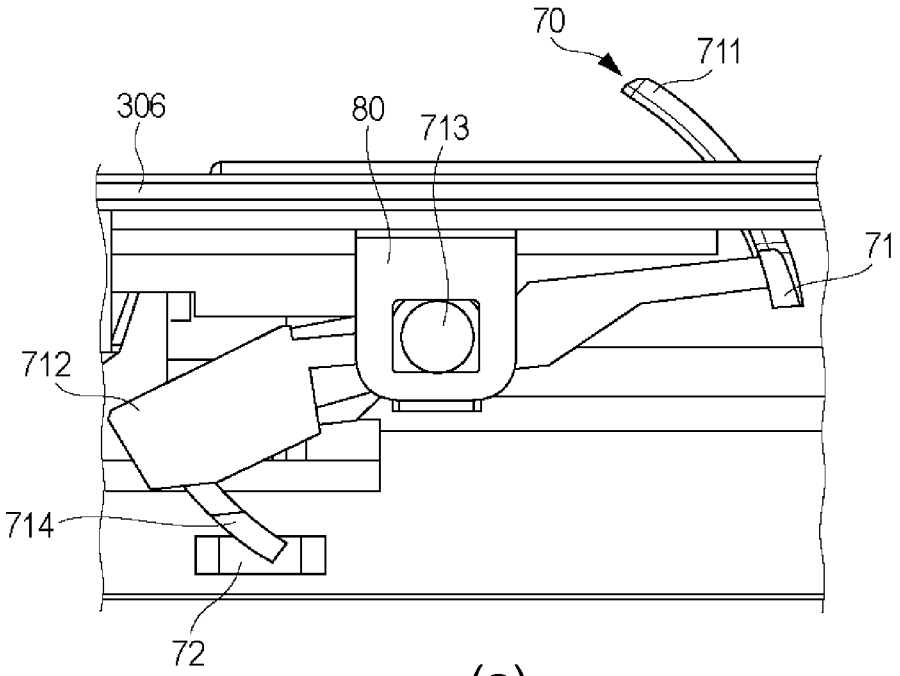
Figure 6:
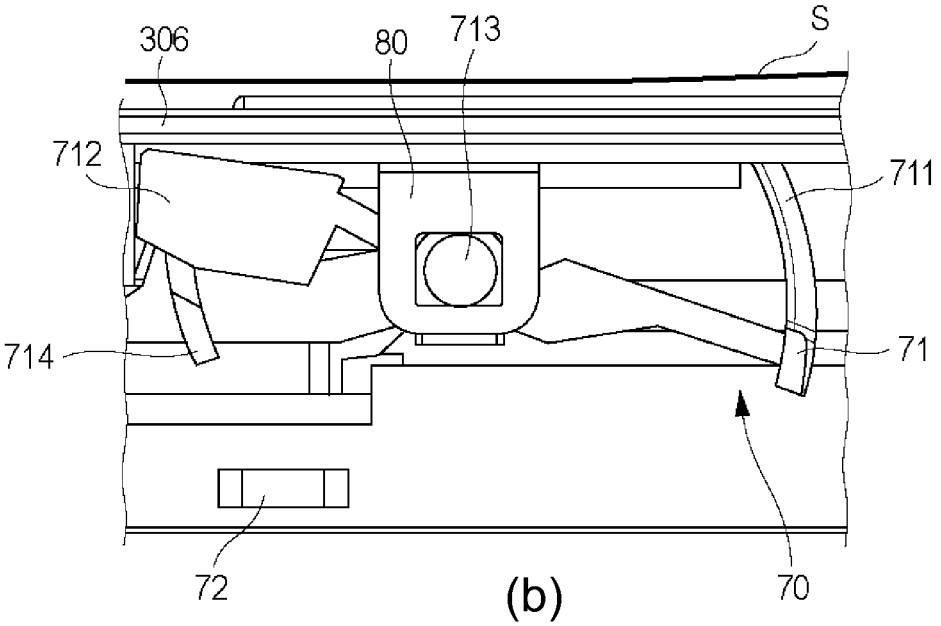

Parts (a) and (b) of FIG. 6 are sectional views showing a holding structure of an original detecting portion in the embodiment 1.

Figure 7:
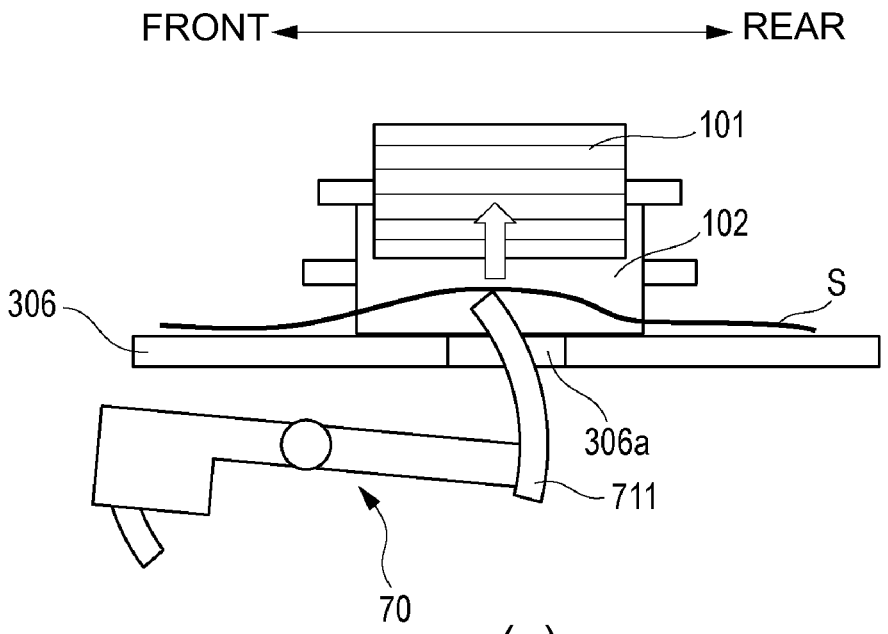
Figure 7:
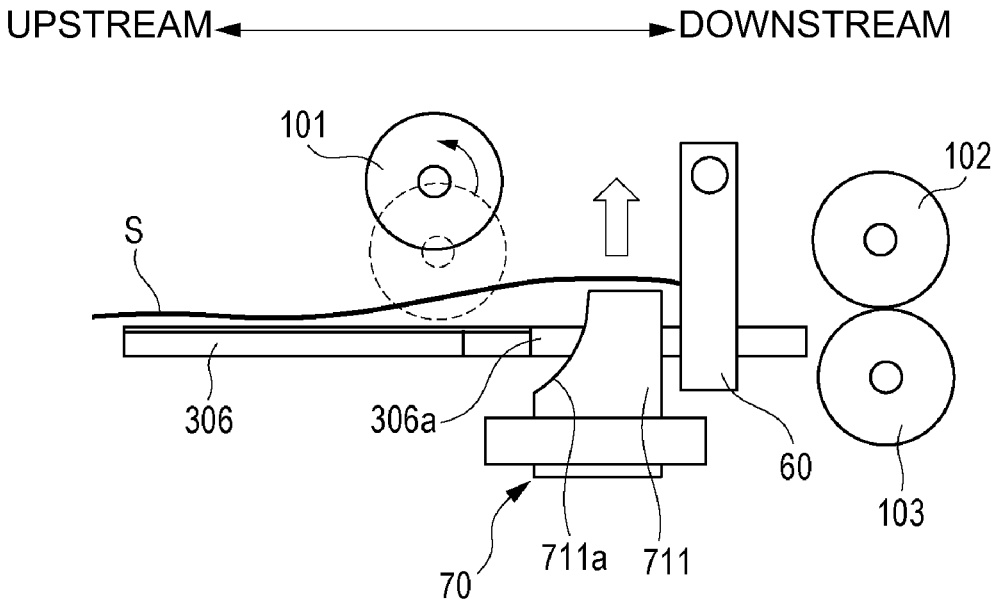

Parts (a) and (b) of FIG. 7 are schematic views of the feeding portion when an original is set on an original tray in the embodiment 1.

Figure 8:
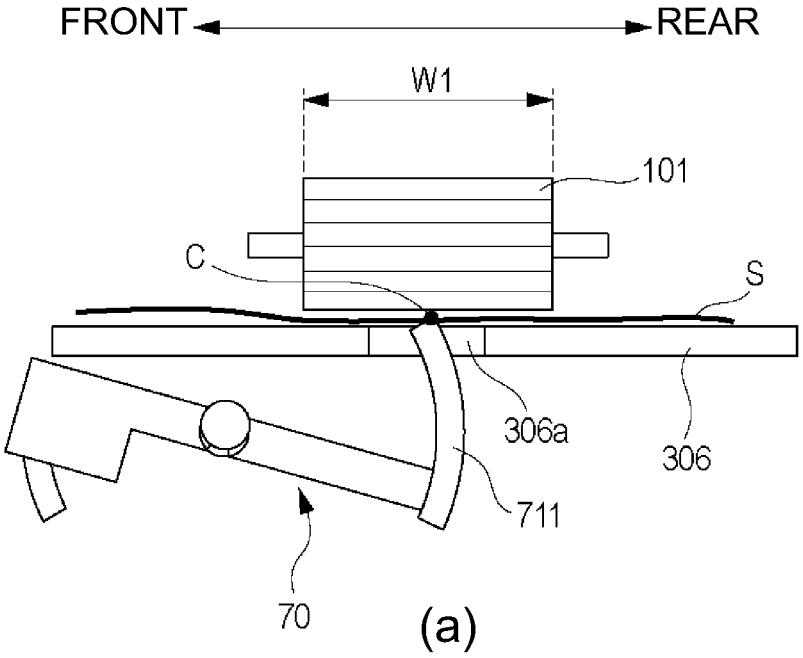
Figure 8:
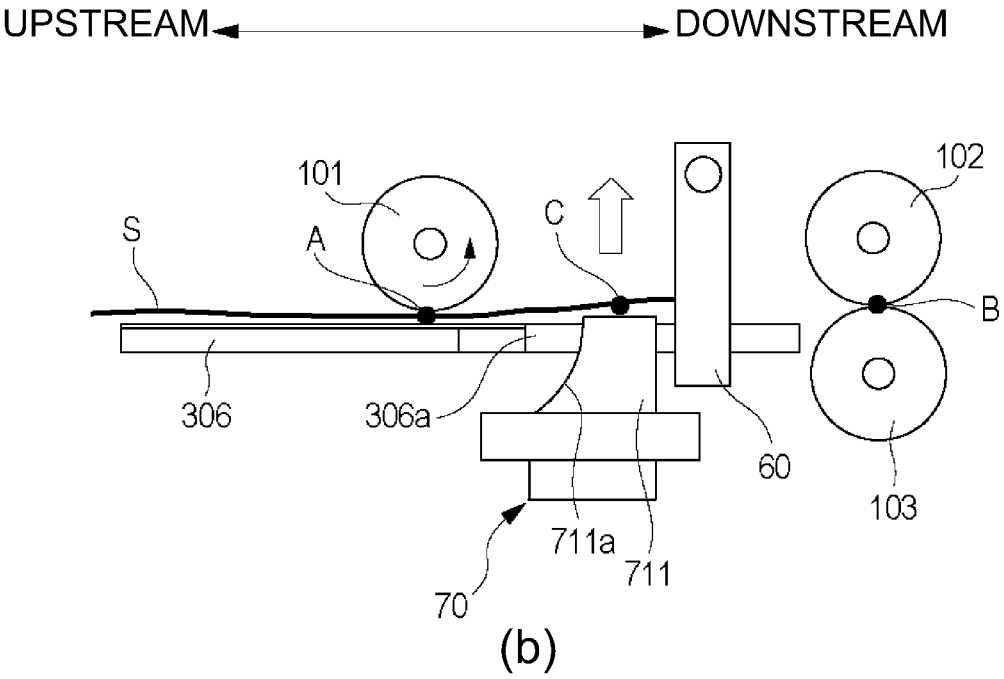

Parts (a) and (b) of FIG. 8 are schematic views of the feeding portion when feeding of the original set on the original tray is started in the embodiment 1.

Figure 9:
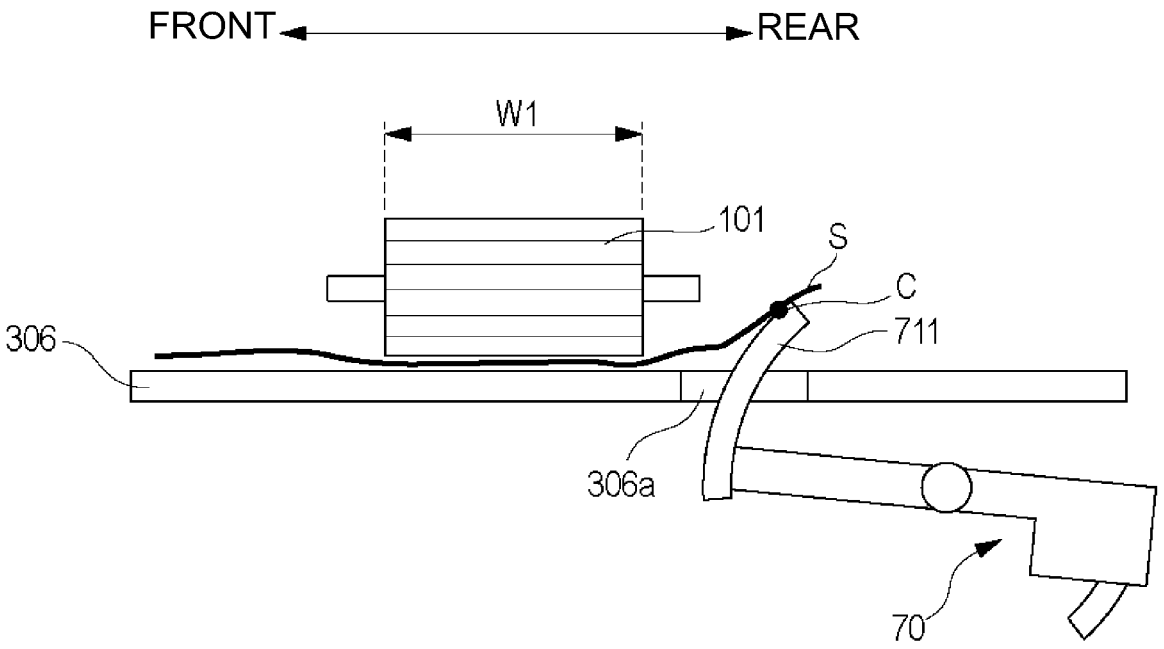

FIG. 9 is a schematic view of a feeding portion when an original detecting portion is provided outside a region of a width of a feeding roller.

Figure 10:
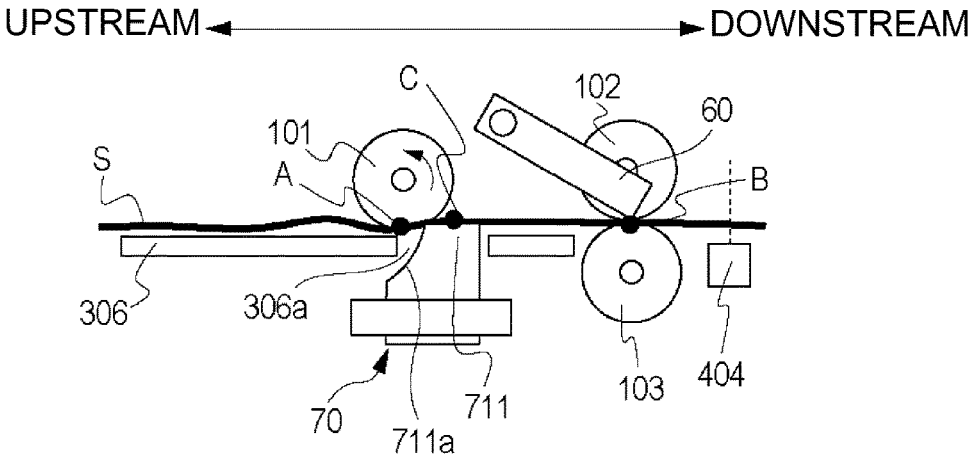
Figure 10:
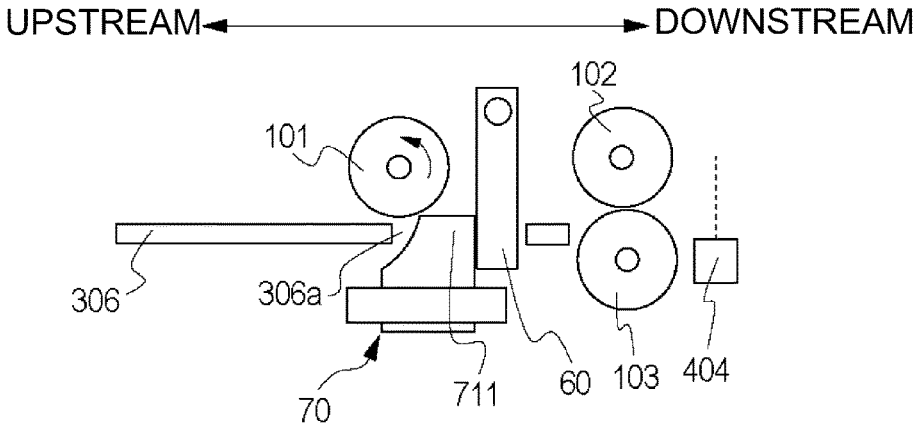
Figure 10:
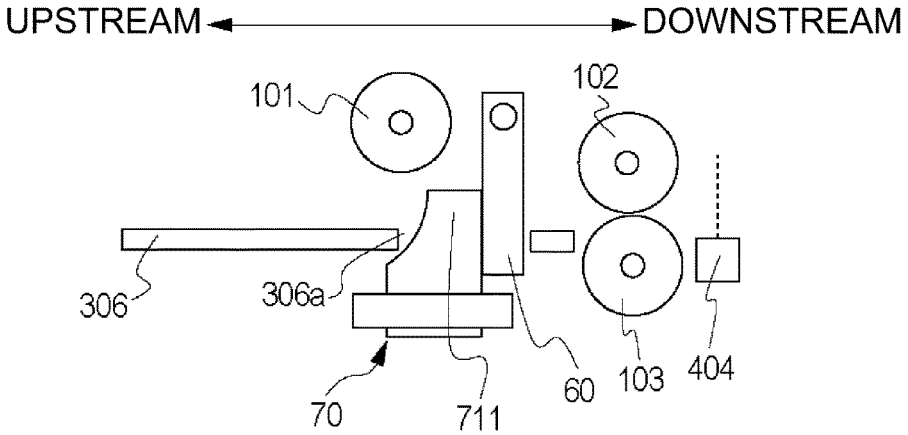

Parts (a) to (c) of FIG. 10 are schematic views for illustrating a feeding operation of an original in an embodiment 2 of the present invention.

Figure 11:
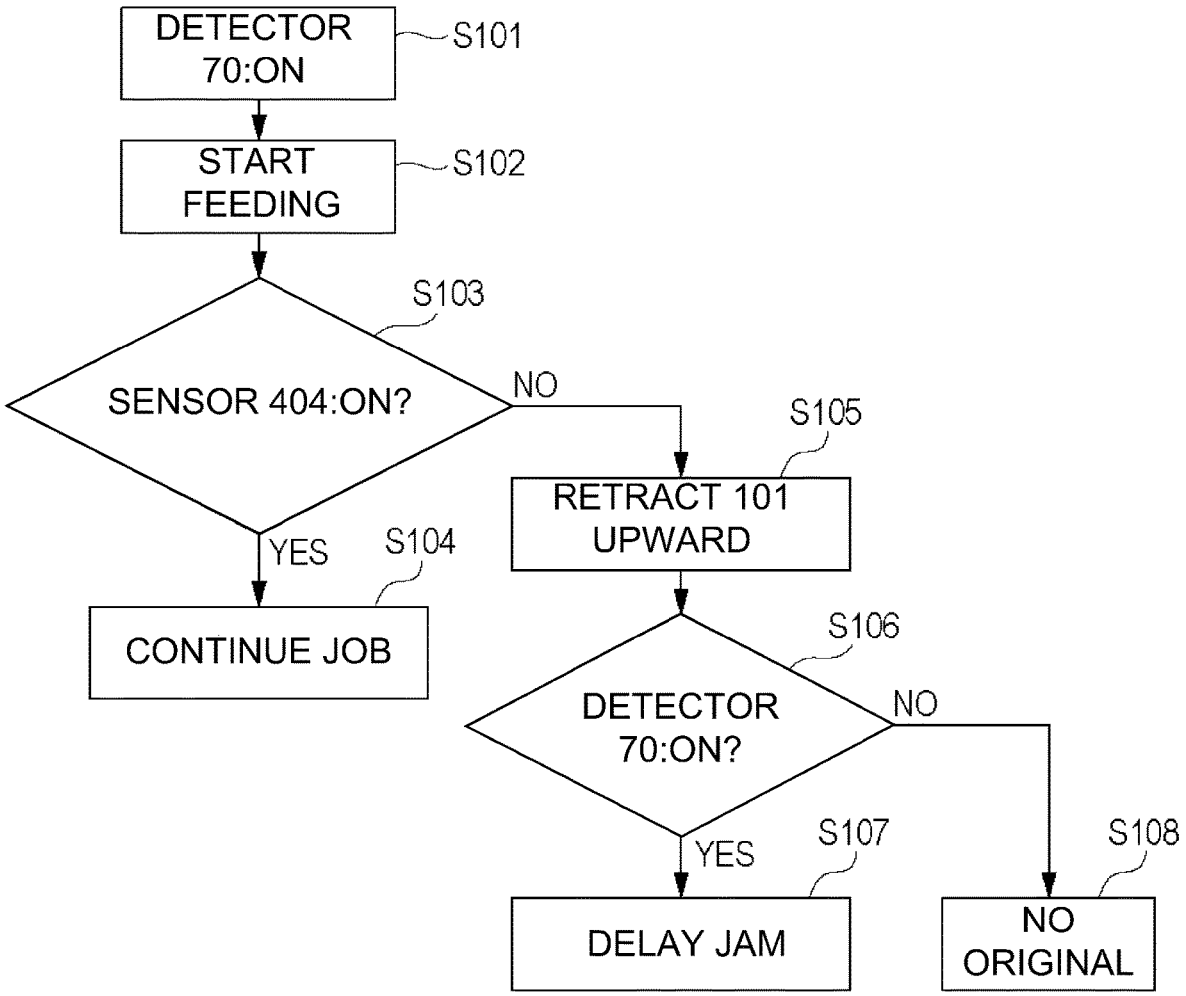

FIG. 11 is a flowchart showing the feeding operation in the embodiment 2.

DESCRIPTION OF EMBODIMENTS

Embodiments of the present invention will be specifically described with reference to the drawings. Dimensions, materials, shapes and relative arrangement of constituent elements described in the following embodiments should be appropriately be changed depending on structures and various conditions of devices and apparatuses to which the present invention is applied, and the scope of the present invention is not intended to be limited thereto.

Embodiment 1

<Image Forming Apparatus>

Figure 1:
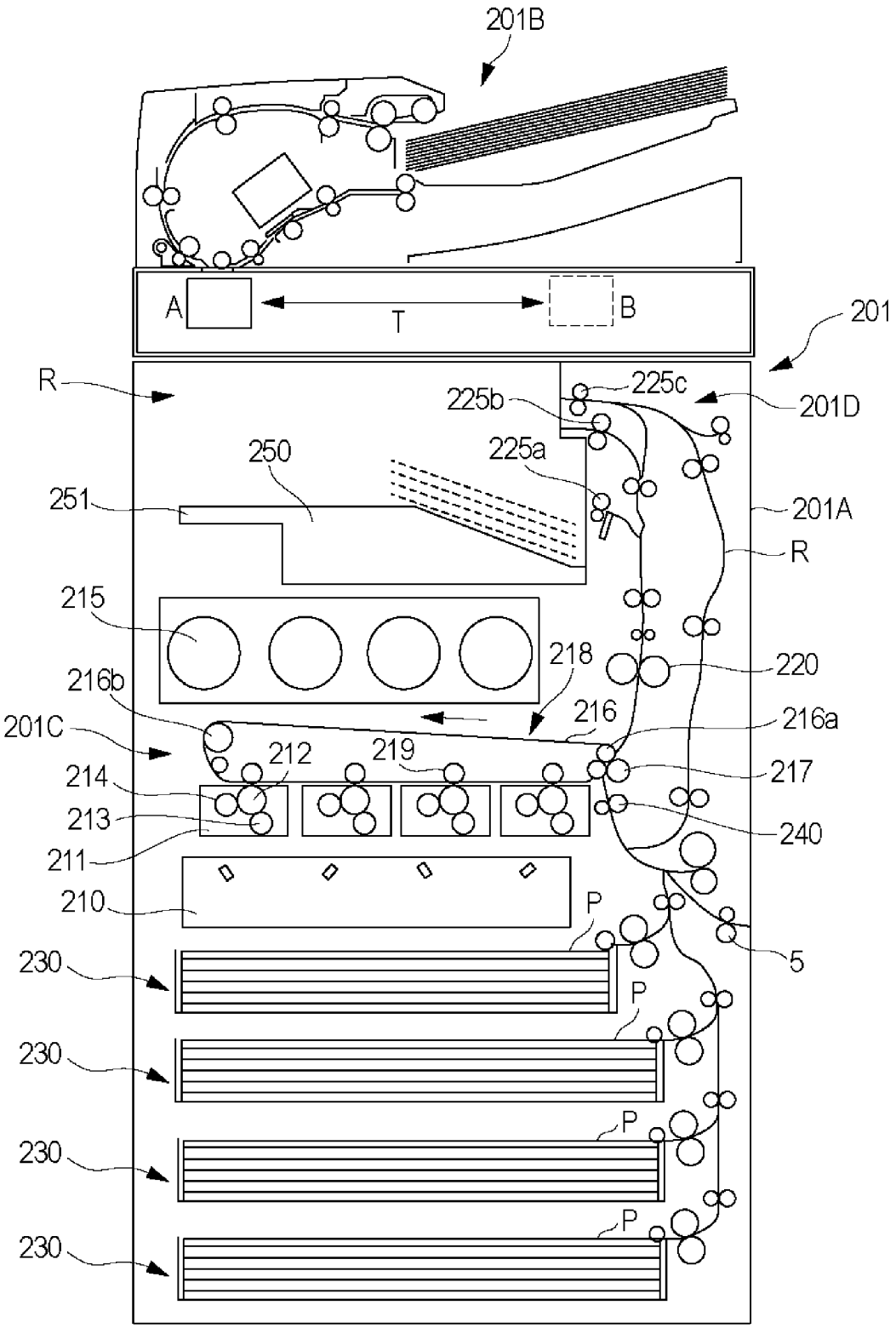
FIG. 1 is a sectional view of an image forming apparatus in which an original reading apparatus including a sheet feeding device is mounted in an embodiment 1.

FIG. 1 is a sectional view showing an image forming apparatus 201 according to an embodiment 1 of the present invention. The image forming apparatus 201 is constituted by an image forming apparatus main assembly 201A for forming an image and an original reading apparatus 201B which is provided on the image forming apparatus main assembly 201A and which is sheet reading apparatus for reading an image of an original. Here, a sheet fed in the image forming apparatus main assembly 201A is referred to as a sheet P, and a sheet fed in the original reading apparatus 201B is referred to as an original S.

First, the image forming apparatus main assembly 201A will be described. The image forming apparatus main assembly 201A is divided into an image forming portion 201C and a sheet feeding portion 201D. The image forming portion 201C employs a four-drum full-color type and includes a laser scanner 210 and process cartridges 211 for forming toner images of four colors of yellow, magenta, cyan and black. Each of the process cartridges 211 includes a photosensitive drum 212, a charging device 213, and a developing device 214 for developing an electrostatic latent image, and forms a toner image. The image forming portion 201*c* further includes an intermediary transfer unit 218 on the process cartridges 211, a fixing device 220 and toner cartridges 215 each for supplying toner to an associated developing device 214.

The intermediary transfer unit 218 is constituted by an intermediary transfer belt 216, primary transfer rollers and the photosensitive drums 212. The intermediary transfer belt 216 includes a driving roller 216*a* and a tension roller 216*b* and rotates in an arrow direction in FIG. 1. At a position opposing the driving roller 216*a* of the intermediary transfer unit 218, a secondary transfer roller 217 constituting a secondary transfer portion where a color image formed on the intermediary transfer belt 216 is transferred onto the sheet P.

Above the secondary transfer roller 217, the fixing portion 220 is disposed, where the transferred toner image (color image) is fixed.

Next, the sheet feeding portion 201D will be described. Below the image forming portion 201C, a sheet (paper) feeding device 230 is provided. The sheet feeding device 230 feeds sheets P, stacked in a plurality of cassettes, one by one toward the secondary transfer portion for transferring the image on the sheet P while providing timing by a registration roller pair 240. On the sheet P on which the image is transferred is fixedly by the fixing portion 220. Above the fixing portion 220, a first sheet discharging roller pair 225*a*, a second sheet discharging roller pair 225*b* and a reverse roller pair 225*c* are provided. In the case where the image is printed on only one side (surface) of the sheet P, the sheet P is fed by the first sheet discharging roller pair 225*a* or the second sheet discharging roller pair 225*b* and then is discharged onto a sheet discharge tray 250. The sheet discharge tray 250 is provided with a sheet discharge extension tray 251 which can be appropriately extended. As a result, it becomes possible to prevent a deterioration in stacking property such that the discharged sheet P drops to an outside of the image forming apparatus 201. On the other hand, in the case where images are printed on double sides (surfaces) of the sheet P, the sheet P is fed to the reverse roller pair 225*c*. Then, the sheet P is switched back by reversely rotating the reverse roller pair 225*c* so that a leading end and a trailing end of the fed sheet P are changed to each other. The sheet P switched back passes through a double-side (printing) feeding passage R and is fed again to the registration roller pair 240, so that the image is formed on a back surface of the sheet P.

As described above, a series of operations of image formation and sheet feeding is carried out, so that the image is formed on the sheet P and then the sheet P on which the image is formed is discharged onto the sheet discharge tray 250.

<Original Reading Apparatus>

Figure 2:
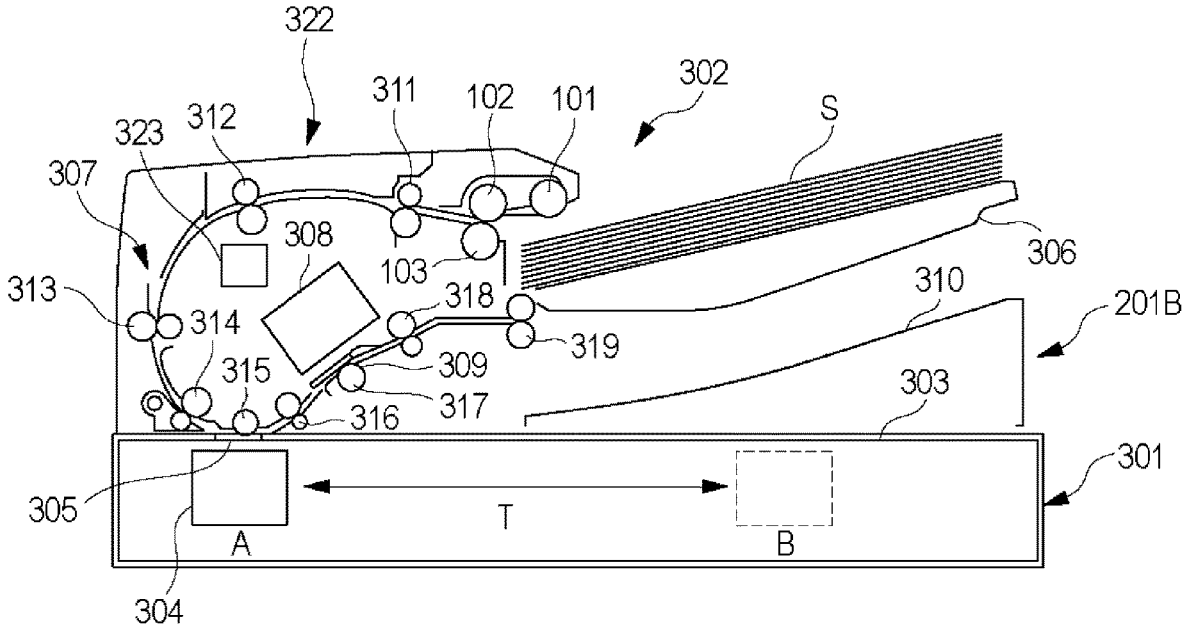
FIG. 2 is a sectional view of the original reading apparatus of the embodiment 1.
Figure 3:
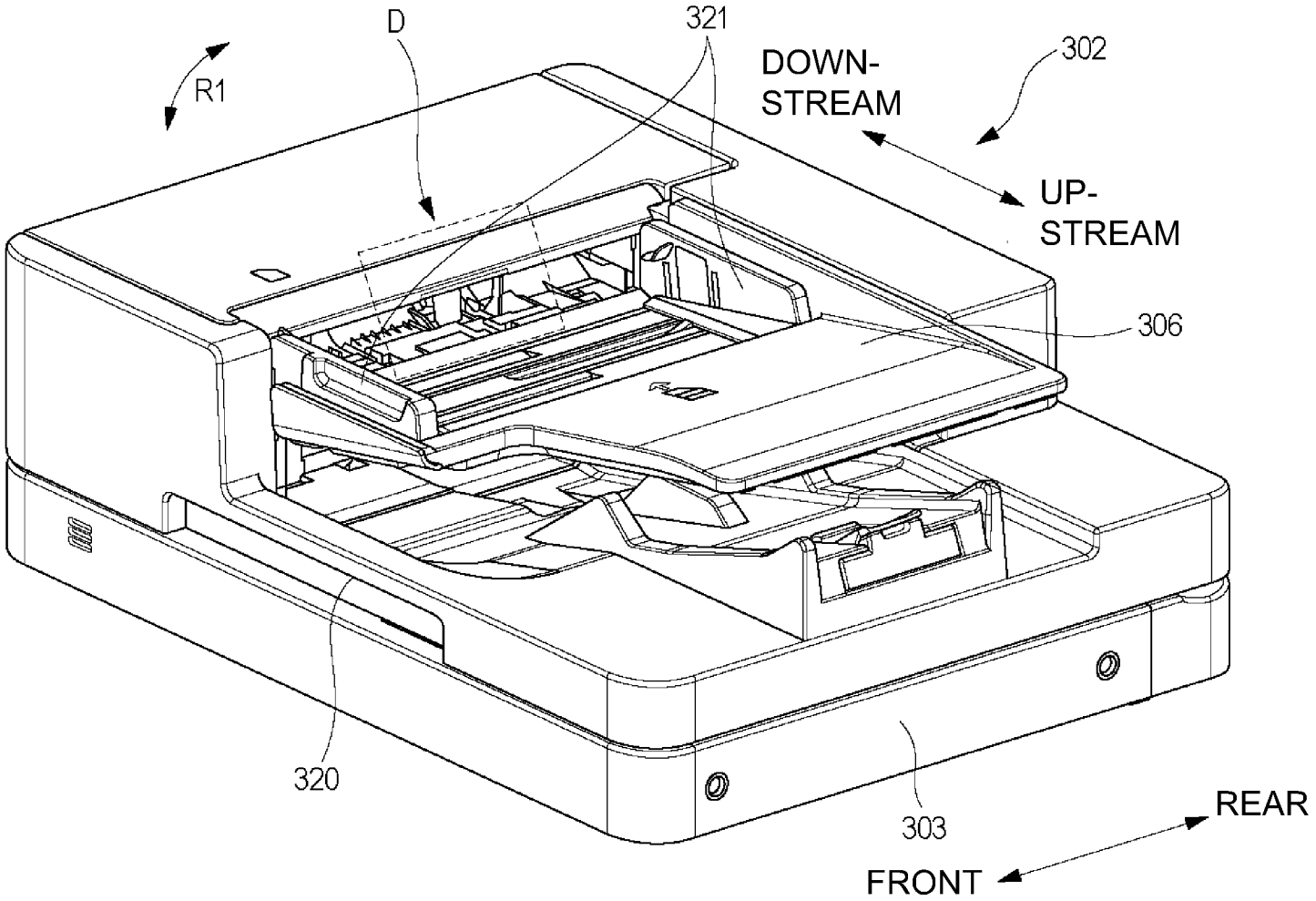
FIG. 3 is a perspective view of an outer appearance of the original reading apparatus of the embodiment 1.

Next, the original reading apparatus 201B will be specifically described using FIGS. 2 and 3. FIG. 2 is a detailed sectional view of the original reading apparatus 201B in FIG. 1, FIG. 3 is a perspective view of an outer appearance of the original reading apparatus 201B. As shown in FIG. 2, the original reading apparatus 201B includes a reader portion 201 for reading the original and an original feeding portion 302 for feeding the original to the reader portion 301 (hereinafter, the original feeding portion is also referred to as an ADF (Auto Document Feeder).

In the case where the image of the original is read by the original reading apparatus 201B, the following methods of two types exist. A first type is an "original skimming-through reading" in which the image is read while feeding the original, and a second type is an "original fixed reading" in which the image of the original placed on an original platen 303. These reading methods will be described below.

First, the "original-fixed reading" will be described. As described above, when the original-fixed reading is carried out, there is a need to place the original, to be read, on the original platen 303. As shown in FIG. 3, the original platen 303 is provided with an unshown hinge, so that the original feeding portion 302 is openable by rotating a grip portion 320 is an R1 direction. In an open state of the original feeding portion 302 relative to the original platen 303, the original to be read is placed on the original platen 303. Thereafter, the opened original feeding portion 302 is returned to a closed state, and then reading is started.

As shown in FIG. 2, inside the reader portion 301 opposing the placed original, a first image reading means 304 for reading the image is provided. The first image reading means 304 is provided so as to be movable from a position A to a position B in an arrow T direction (sub-scan direction) on an unshown rail provided inside the reader portion 301. That is, relative to the original S placed on the original platen 303, the first image reading means 304 is moved in the sub-scan direction, whereby the original S can be read.

Next, the "original skimming-through reading" will be described. In the case where the original skimming-through reading is carried out, the original feeding portion (ADF) 302 is used. As shown in FIGS. 2 and 3, the original feeding portion 302 is provided with an original tray 306 which is a stacking portion on which the original S is stacked. The original S is stacked on a stacking surface as an upper surface of the original tray 306. The original tray 306 is provided with side restricting plates 321, for restricting a position of the original S with respect to the widthwise direction, so as to be slidable thereon. The side restricting plates 321 restrict the widthwise direction of the original S stacked on the stacking surface of the original tray 306, whereby the position of the original S with respect to the widthwise direction is aligned, so that the original S can be fed.

Above a leading end of the original S stacked on the original tray 306, a feeding cover 322 for opening and closing an original feeding passage of the ADF 302. The feeding cover 322 is provided with a pick-up roller 101 which is a first feeding roller, and the pick-up roller 101 is lowered by a sheet feeding motor which is an unshown driving source, and contacts the original S. Then, t pick-up roller 101 is rotated by the unshown driving source, and feeds the original S toward reading portions 304 and 308.

As shown in FIG. 2, the pick-up roller 101 is retracted in general to a separated position which is a home position where the pick-up roller 101 is separated from an uppermost original S, so that when a user stacks originals S on the original tray 306, the pick-up roller 101 does not constitute an obstacle to setting of the originals S. When the original S is fed, the pick-up roller 101 is lowered from the separated position and is moved to a feeding position where the pick-up roller 101 contacts an upper surface of the original S, and then feeds the original S to a separating portion provided on a side downstream of the feeding position with respect to an original feeding direction which is a sheet feeding direction. The separating portion is constituted by a feed roller 102 which is a second feeding roller and a retard roller 103 which is a separating member, and forms a nip. The feed roller 102 is a roller for feeding the original S, fed by the first feeding roller, toward the downstream side of the original feeding direction, and the retard roller 103 is a roller, press-contacting the feed roller 102, for separating an original bundle, fed by the pick-up roller 101, one by one.

The thus-separated (single) original S is fed by a drawing roller pair 311 provided on a side downstream of the feed roller 102 with respect to the original feeding direction. Then, the original S fed by the drawing roller pair 311 is fed to a registration roller pair 313 by a feeding roller pair 312. The registration roller pair 313 is temporarily at rest, and the leading end of the original S is abutted against a nip of the registration roller pair 313, so that the original S is flexed and thus oblique movement of the leading end of the original S is corrected. The flexure of the original S when the oblique movement of the leading end of the original S is corrected falls within a loop space 307. Further, on a side downstream of the registration roller pair 313 with respect to the original feeding direction, a first lead roller pair 314, a first platen roller 315, a second lead roller pair 316, a second platen roller 317 and a third lead roller pair 318 are provided in a named order. On a side downstream of the third lead roller pair 318 with respect to the original feeding direction, a discharging roller pair 319 for discharging the original S, after being subjected to the image reading, onto a discharge tray 310 is provided. The original S discharged by the discharging roller pair 319 is discharged on the discharge tray 310.

The original S subjected to the correction of the oblique movement is fed to a front surface image reading position on a first platen glass 305 by the first lead roller pair 314. In the front surface image reading position, an image of a first surface which is a front surface of the original S is read while being fed by the first image reading means 304 provided in the reader portion 301 as described above. At this time, the first image reading means 304 is at rest in a position A. The original S subjected to reading of the image on the front surface thereof is sent onto a second platen glass 309 by the second platen roller 317, and then the image of a back surface of the original S is read by the second image reading means 308. In the case where the original S is fed by the original feeding portion 302, the images of the front and back surfaces of the original S can be read by the first image reading means 304 and the second image reading means 308. That is, the first image reading means 304 reads the front surface image of the original S fed by the original feeding portion 302, and the second image reading means 308 reads the back-surface image of the original S fed by the original feeding portion 302.

The originals S stacked on the original tray 306 are successively and automatically sent to the reading portions 304 and 308. Incidentally, the pick-up roller 101 is held during a job at the feeding position where the pick-up roller 101 contacts the original S, and is raised at the time of an end of the job.

<Structure and Arrangement of Original Detecting Portion in Original Feeding Portion>

Figure 4:
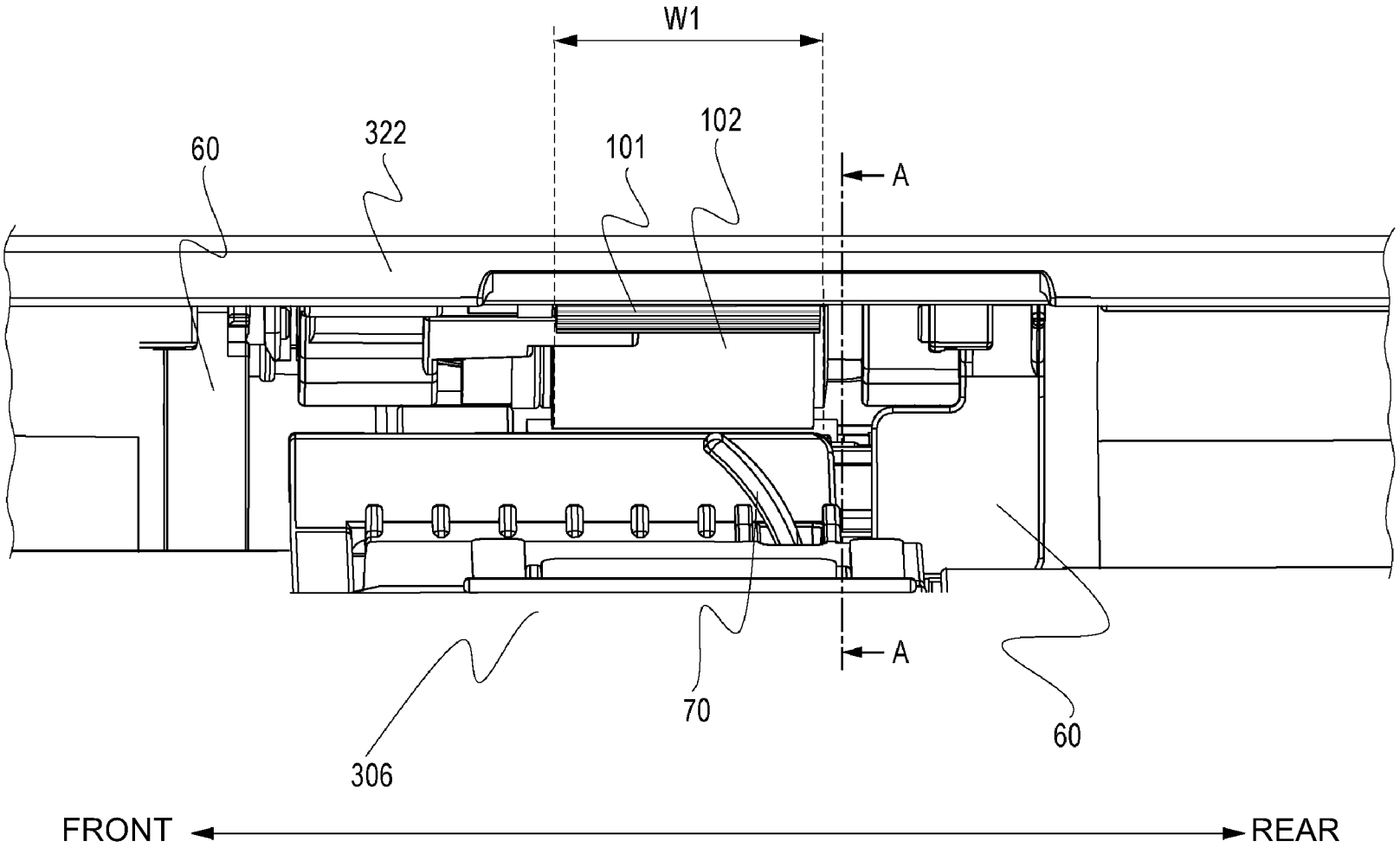
FIG. 4 is an enlarged view showing a feeding portion of an original feeding portion in the embodiment 1.
Figure 5:
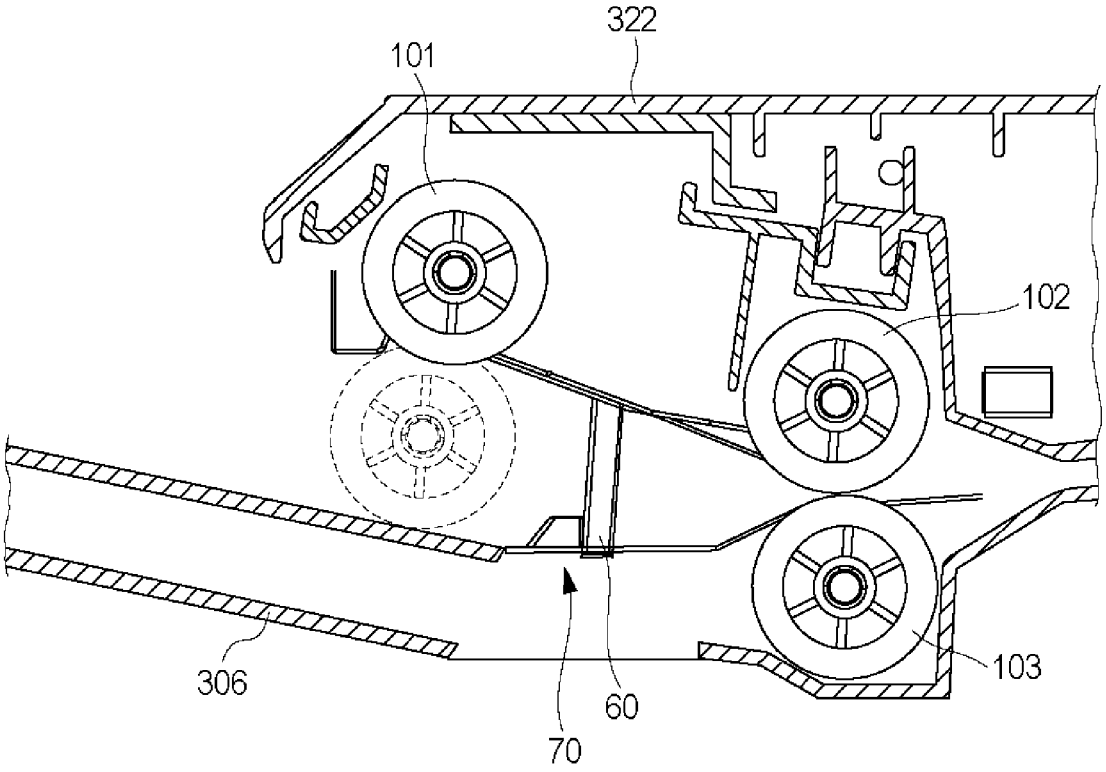
FIG. 5 is a sectional view of the feeding portion in the embodiment 1.

Next, a characteristic portion of the present invention will be described using FIGS. 4 and 5. FIG. 4 is a schematic view showing a feeding portion D of FIG. 3 where the original S is fed from the original tray 306 side. FIG. 5 is a sectional view of the original feeding portion 302 taken along an A-A line of FIG. 4.

An openable cover portion 322 is provided with the feeding roller 101 for feeding the original S and a stopper 60 which is a leading end restricting member for restricting the leading end of the original S when an unshown original bundle is stacked on the original tray 306. The stopper 60 is disposed at two positions, i.e., on a front side and a rear side through the feeding roller 101 having a length (width) W1 with respect to the widthwise direction perpendicular to the feeding direction in which the original S is fed to be fed. Further, the stopper 60 is disposed between the feeding roller 101 and the feed roller 102 with respect to the original feeding direction. As a result, the leading end of the originals set on the original tray 306 can be abutted against the stoppers 60 at the two positions, so that a degree of oblique movement of the originals during setting can be reduced. Further, the stoppers 60 are provided between the feeding roller 101 and the feed roller 102, whereby during abutment of the originals, the leading end of the original cannot enter the nip between the feed roller 102 and the retard roller 103. Incidentally, the stoppers 60 are held at positions shown in FIG. 5 when the feeding roller 101 is in the separated position, and are released when the feeding roller 101 is in the feeding position. The released stoppers 60 are pushed up by the leading end of the original fed by the feeding roller 101, so that the original is capable of being fed.

Next, detection of the original set on the original tray will be described. The original set on the original tray 306 is detected by an original detecting portion 70 which is a sheet detecting portion provided in the original tray 306. Similarly, as the above-described stopper 60, the original detecting portion 70 is also disposed substantially at a central portion of the widthwise direction perpendicular to the original feeding direction. Parts (a) and (b) of FIG. 6 are sectional views showing the original tray 306 and the original detecting portion 70 in FIG. 4. Part (a) of FIG. 6 shows a state of a flag 71 before the original S is stacked on the original tray 306. Part (b) of FIG. 6 is a state of the flag 71 after the original S is stacked on the original tray 306. As shown in FIG. 6, the original detecting portion 70 is constituted by a flag which is a movable member 71 of a mechanical flag type and by an original detecting sensor 72 which is a detecting portion for detecting one end 714 of the movable member 71. As the detecting sensor 72, a photosensor which is a light-transmission sensor was employed.

Further, the flag 71 is constituted by a free end portion 711 contactable to the original S, a weight portion 712, a shaft portion 713 and a light-blocking portion 714. An original detecting and holding portion 80 which is a part of the original tray 306 is provided with a hole in which the shaft portion 713 of the flag 71 is supported so as to be rotatable. Further, the shaft portion 713 is provided in a pair at two positions with respect to the original feeding direction. The original detecting and holding portion 80 has flexibility, and when the flag 71 is incorporated therein, the flag 71 can be assembled by flexing the original detecting and holding portion 80.

One end of the flag 71 is provided with the free end portion 711 contactable to the original S, and the other end of the flag 71 is provided with the weight portion 712 and the light-blocking portion 714 for blocking light passing through the photo-sensor. The flag 71 is rotatable about the shaft portion 713 as a rotation center, and in the case where the original S is not set on the original tray 306, the free end portion 711 of the flag 71 contactable to the original S is urged by a weight of the weight portion 712 so as to project upward from the stacking surface of the original tray 306. At this time, a light beam of the photo-sensor 72 is blocked by the light-blocking portion 714 of the flag 71 (part (a) of FIG. 6). Then, in the case where the original S is set on the original tray 306, the original S presses down the free end portion 711, and thus the light beams passes through the photo-sensor 72, so that the original detecting portion 70 is capable of detecting that the original was set on the original tray 306 (part (b) of FIG. 6). Further, with respect to the original feeding direction, from an upstream state, the feeding roller 101, the flag 71, the stopper 60 and the feed roller 102 are device in a named order. For that reason, when the original S is set on the original tray 306 so that the leading end thereof is abutted against the stopper 60, presence of the original S can be detected by the original detecting portion 70.

Next, the arrangement of the original detecting portion 70 will be described using parts (a) and (b) of FIG. 7. Part (a) of FIG. 7 is a schematic view of the sheet feeding portion as seen from the upstream side of the original feeding direction when the original S is set on the original tray 306. Part (b) of FIG. 7 is a schematic view of the sheet feeding portion as seen along the original feeding direction when the original S is similarly set on the original tray 306.

The free end portion 711 of the flag 71 projects upward through a slit 306*a* provided in the stacking surface of the original tray 306. The free end portion 711 is substantially disposed at a center within widths of the feeding roller 101 and the feed roller 102. In this state, when the original S is set on the original tray 306, the free end portion 711 is pressed down by the original S. At this time, the original S receives a reaction force from the free end portion 711 in an upward arrow direction in part (a) of FIG. 7. At this time, for example, in the case where the original S is thin paper such as a receipt, a weight of the original S is extremely light and rigidity thereof is weak, and therefore, the original S has a shape in some instances such that the original S waves upward from the free end portion 711 as a starting point.

Part (b) of FIG. 7 is the schematic view showing a cross-section of the sheet feeding portion along the original feeding direction. The free end portion 711 of the flag 71 is disposed between the feeding roller 101 and the stopper 60. The free end portion 711 is disposed close to the stopper 60 to the extent possible so that the original detecting portion 70 can detect the original S even when the leading end of the original S is curled. On the other hand, the feeding roller 101 is moved to a lower feeding position (broken-line portion) during a feeding operation, and therefore, the free end portion 711 is disposed at a position where the free end portion 711 does not contact the feeding roller 101 during feeding of the original S. This is because the feeding roller 101 is prevented from being erroneously detected as the original S.

Further, the free end portion 711 is provided with an inclined surface 711*a*. The inclined surface 711*a* has an arcuate shape which is substantially concentrically with an outer diameter circle of the feeding roller 101, so that the original detecting portion 70 is disposed so as to be capable of detecting the original S to the extent possible even on an upstream side of the original feeding direction with a range in which the inclined surface 711*a* does not interfere with the feeding roller 101. Further, when the original S is set on the original tray 306, in order to prevent the original S from being caught by the free end portion 711, the free end portion 711 has the arcuate shape as shown in part (a) of FIG. 7, so that the original S can smoothly move along the inclined surface 711*a* when the original S is set on the original tray 306.

<Behavior of Original During Sheet Feeding Operation>

Behavior of the original S during the sheet feeding operation will be described using parts (a) and (b) of FIG. 8. Part (a) of FIG. 8 is a schematic view showing the sheet feeding portion as seen from the upstream side of the original feeding direction when the feeding roller 101 is contacted to the original S. Part (b) of FIG. 8 is a sectional view showing the sheet feeding portion as seen in the original feeding direction when the feeding roller 101 is similarly contacted to the original S.

When the sheet feeding operation is started, the feeding roller 101 moves downward from a separated position where the feeding roller 101 is separated from the original S to a lower position which is a feeding position. As shown in part (a) of FIG. 8, the original S is sandwiched between the feeding roller 101 and the original tray 306. Specifically, with respect to the widthwise direction perpendicular to the original feeding direction, a first contact position C where the original S and the free end portion 711 of the flag 71 are in contact with each other was positioned inside a region W1 where the feeding roller 101 and the original S are in contact with each other. In this embodiment, as a material of the feeding roller 101, a rubber member which is EPDM is used, a length of the rubber member with respect to the widthwise direction is about W1. For this reason, the original S is held in a state in which the sheet S does not wave upward from the free end portion 711 as a starting point. On the other hand, part (b) of FIG. 8 shows a cross-section of the sheet feeding portion along the original feeding direction. With respect to the original feeding direction in part (b) of FIG. 8, similarly, the feeding roller 101 moves downstream to the lower position which is the feeding position, and therefore, the original S is sandwiched between the feeding roller 101 and the original tray 306. As shown in part (b) of FIG. 8, the original S receives an upward force from the free end portion 711 at the contact position C, but the original S is sandwiched between the feeding roller 101 and the original tray 306 at an immediately upstream portion of the free end portion 711. A position where the feeding roller 101 contacts the original S is referred to as a second contact position A. At this time, the original S can be held in a state in which a degree of upward waving of the original S is small. Incidentally, on a side downstream of the contact position C, a nip B between the feed roller 102 and the retard roller 103 is provided, so that the contact position C is positioned between the contact position A and the nip B.

Here, for comparison with this embodiment, the case where the contact position where the free end portion 711 of the flag 71 contacts the original S is positioned on a side closer to a side end portion of the original S (sheet) with respect to the widthwise direction than a region in which the feeding roller 101 contacts the original S is will be described using FIG. 9. FIG. 9 is a schematic view showing the sheet feeding portion as seen from the upstream side of the original feeding direction.

In this case, a position where the original S receives a force from the free end portion 711 of the flag 71 is positioned outside the width W1. For this reason, narrow and thin paper very light in self weight is fed in a state in which an end portion of the original S is raised as shown in FIG. 9. In the neighborhood of the sheet feeding portion, an inlet is provided broadly in many instances so that originals S in a large volume can be set. For this reason, in the case where the original S in the raised state as shown in FIG. 9 is fed, the original S is caught by the feeding guiding member and thus causes a paper (sheet) jam, corner folding, oblique movement and the like.

As described above, in the sheet detecting portion provided with the mechanical flag and the sensor, when the original S is set, with respect to the widthwise direction perpendicular to the original feeding direction, the contact position C where the flag contacts the original S is disposed inside the region W1 where the feeding roller 101 contacts the original S. Further, with respect to the original feeding direction, the contact position C is disposed between the contact position A where the feeding roller 101 contacts the original S (sheet) and the nip N formed by the feed roller 102 and the separation roller 103. As a result, the original S stacked on the original tray 306 can be fed without causing the paper jam, the corner folding, the oblique movement or the like by being caught by the feeding guiding member or the like.

Embodiment 2

In the embodiment 1, when the feeding roller 101 moves downstream to the lower feeding position during the sheet feeding operation with respect to the original feeding direction, the surface of the feeding roller 101 and the flag 71 were disposed in the non-contact positions. This is because in the embodiment 1, the feeding roller 101 is kept in the feeding position until a job is ended. When the feeding roller 101 contacts the flag 71, final original paper (sheet) cannot be detected. That is, whether the flag 71 is detected by being pressed by the original S or by the feeding roller 101 cannot be discriminated.

However, as the embodiment 2, in arrangement in which the flag 71 contacts the feeding roller 101 during the sheet feeding, an effect similar to the effect of the embodiment 1 can be achieved, and this will be described using parts (a) to (c) of FIG. 10. Part (a) of FIG. 10 is a schematic view showing the sheet feeding portion during an operation of feeding a final sheet (original) S set on the original tray 306. Part (b) of FIG. 10 is a schematic view showing the sheet feeding portion in a state in which the feeding of the final sheet S set on the original tray 306 is ended. Part (c) of FIG. 10 is a schematic view showing the sheet feeding portion in a state in which the feeding roller 101 is separated upward from the original tray 306.

In the embodiment 2, a post-separation sensor 404 which is a post-separation detecting portion for detecting the original S fed was provided downstream of the nip B between the feed roller 102 and the separating member 103. In this embodiment, as the post-separation sensor 404, a reflection(-type) sensor was employed. The reflection sensor 404 includes a light-emitting portion and a light-receiving portion and is provided on one end side of the feeding passage along which the original is fed. A light beam emitted from the light-emitting portion is disposed so as to cross the original feeding passage, and when the original is fed, the light beam is reflected by the original and then is received by the light-receiving portion.

In the constitution of the embodiment 2, the feeding of the original will be specifically described with reference to parts (a) to (c) of FIG. 10 and FIG. 11. The original reading apparatus 201B is provided with a sheet feeding motor, as a driving source, for imparting rotational drive to the first feeding roller 101 and the second feeding roller 102, the original detecting sensor 72 for detecting the original stacked on the original tray 306, and the post-detection sensor 404 disposed on the side downstream of the second feeding roller 102. The original reading apparatus 201B is provided with a controller 323 which is a CPU, and when the original is fed, the motor is controlled on the basis of signals of various sensors.

In part (a) of FIG. 10, a cross-section of the original feeding portion where the final original S is fed by the feeding roller 101, and at this time, similarly as in the embodiment 1, the controller 323 obtains a signal of the original detecting sensor 72 (S101, S102). In the embodiment 2, by mounting the post-separation sensor 404 on a side downstream of a separating portion with respect to the original feeding direction, whereby the controller 323 detects the original S fed (S103). Then, as shown in part (b) of FIG. 10, after the final original is fed, the feeding roller 101 is held in a state in which the free end portion 711 of the flag 71 is pressed down, and therefore, the controller 323 acquires a signal of the original detecting sensor 72. For this reason, the controller 323 discriminates that the original S is present, and the feeding roller 101 is rotated by the feeding motor. However, the final original has already been fed in actuality, and therefore, the original S is not fed, so that the original S does not reach the post-separation sensor 404. Here, in a period from a start of the rotational drive of the feeding roller 101 to a predetermined time, when the controller 323 does not detect the signal of the post-separation sensor 404, the controller 323 discriminates that the original is absent, and then as shown in part (c) of FIG. 10, the controller 323 causes the feeding roller 101 to be retracted upward (S105). When the feeding roller 101 is retracted upward, there is no original on the original tray 306, and therefore, the flag 71 is rotated, so that the controller 323 discriminates that the original is absent (S108). As a result, the controller 323 ends the job. On the other hand, in the case where the original detecting portion 70 detects the original S, the controller 323 discriminates that the original S fed is delayed and thus discriminates that the jam occurs (S107).

As described above, in the embodiment 2, even in the arrangement in which the flag 71 contacts the feeding roller 101, by disposing the post-separation sensor 404, an effect similarly to the effect of the embodiment 1 can be obtained by controlling the various motors by the controller 323.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-018273 filed on Feb. 5, 2020, which is hereby incorporated by reference herein in its entirety.

What is claimed is:

1. A sheet feeding device comprising:

a stacking portion including a stacking surface on which a sheet is to be stacked;

a first feeding roller movable between a separated position where the first feeding roller is separated upward with respect to a vertical direction from the sheet stacked on the stacking surface and a feeding position where the first feeding roller contacts and feeds the sheet stacked on the stacking portion;

a second feeding roller provided on a side downstream of the first feeding roller with respect to a sheet feeding direction and configured to feed the sheet;

a separating member configured to press-contact a surface of the second feeding roller and to separate sheets, fed by the first feeding roller, one by one;

a movable member including a contact portion which is provided so as to project from the stacking surface upward in the vertical direction and which is contactable to the sheet stacked on the stacking portion and a shaft portion extending along the sheet feeding direction, wherein the movable member rotates about the shaft portion in contact with the sheet when the sheet is stacked on the stacking portion; and a detecting portion configured to detect the sheet stacked on the stacking portion based on a rotation of the movable member, wherein the contact portion is disposed to overlap with the first feeding roller as viewed in the sheet feeding direction, and wherein, in a widthwise direction perpendicular to the sheet feeding direction, the contact portion is disposed on the same side as a center of the first feeding roller with respect to the shaft portion.

2. The sheet feeding device according to claim 1, wherein, with respect to the sheet feeding direction, the contact portion is between a contact position where the first feeding roller contacts the sheet and a nip formed by the second feeding roller and the separating member.

3. The sheet feeding device according to claim 1, wherein, when the first feeding roller is in the feeding position, the first feeding roller and the movable member are in non contact with each other.

4. The sheet feeding device according to claim 1, wherein, when the sheet is stacked on the stacking surface, the first feeding roller is kept at the separated position.

5. The sheet feeding device according to claim 1, further comprising a leading end restricting member configured to restrict a leading end of the sheet when the sheet is stacked on the stacking surface, wherein, with respect to the widthwise direction, the leading end restricting member is positioned on a side such that a distance of the leading end restricting member to a side end of the sheet is closer than a distance of the first feeding roller and the movable member to the side end of the sheet.

6. A sheet reading apparatus comprising:

the sheet feeding device according to claim 1; and a reading portion configured to read an image of the sheet fed by the sheet feeding device.

7. An image forming apparatus comprising:

a sheet reading apparatus having the sheet feeding device according to claim 1 and having a reading portion configured to read an image of the sheet fed by the sheet feeding device; and an image forming portion configured to form an image read by the sheet reading apparatus.

8. The sheet feeding device according to claim 1, wherein the movable member includes a blocking portion configured to block light passing through the detecting portion and includes a weight portion configured to urge the movable member so as to project from the stacking surface upward.

* * * * *